US010337337B2

(12) United States Patent
Brandl

(10) Patent No.: US 10,337,337 B2
(45) Date of Patent: Jul. 2, 2019

(54) BLADING MEMBER FOR A FLUID FLOW MACHINE

(71) Applicant: ANSALDO ENERGIA IP UK LIMITED, London (GB)

(72) Inventor: Herbert Brandl, Waldshut-Tiengen (DE)

(73) Assignee: GENERAL ELECTRIC TECHNOLOGY GMBH, Baden (CH)

( * ) Notice: Subject to any disclaimer, the term of this patent is extended or adjusted under 35 U.S.C. 154(b) by 220 days.

(21) Appl. No.: 14/963,772

(22) Filed: Dec. 9, 2015

(65) Prior Publication Data

US 2016/0177752 A1 Jun. 23, 2016

(30) Foreign Application Priority Data

Dec. 19, 2014 (EP) ..... 14199453

(51) Int. Cl.

| | |
|---|---|
| ***F01D 5/30*** | (2006.01) |
| ***F01D 5/02*** | (2006.01) |
| ***F01D 5/22*** | (2006.01) |
| ***F01D 9/04*** | (2006.01) |

(52) U.S. Cl.

CPC ..... *F01D 5/3007* (2013.01); *F01D 5/02* (2013.01); *F01D 5/225* (2013.01); *F01D 5/3023* (2013.01); *F01D 9/042* (2013.01); *F01D 9/044* (2013.01); *F05D 2220/32* (2013.01); *F05D 2240/30* (2013.01); *F05D 2240/80* (2013.01); *F05D 2260/30* (2013.01)

(58) Field of Classification Search

CPC ..... F01D 5/3007; F01D 5/02; F01D 5/225; F01D 5/3023; F01D 9/042; F01D 9/044; F05D 2220/32; F05D 2240/30; F05D 2240/80; F05D 2260/30

See application file for complete search history.

(56) References Cited

U.S. PATENT DOCUMENTS

| | | | | |
|---|---|---|---|---|
| 5,174,715 | A | 12/1992 | Martin | |
| 5,332,360 | A | 7/1994 | Correia et al. | |
| 5,797,725 | A | 8/1998 | Rhodes | |
| 6,409,473 | B1 | 6/2002 | Chen et al. | |
| 6,648,597 | B1 | 11/2003 | Widrig et al. | |
| 7,686,571 | B1 | 3/2010 | Matheny | |
| 7,704,044 | B1 | 4/2010 | Matheny | |
| 7,761,990 | B2 | 7/2010 | Ellis et al. | |
| 8,257,038 | B2 | 9/2012 | James | |
| 8,469,661 | B2 | 6/2013 | Durocher et al. | |
| 8,496,443 | B2 | 7/2013 | Campbell et al. | |
| 8,721,290 | B2 | 5/2014 | Darkins, Jr. et al. | |
| 8,914,976 | B2 | 12/2014 | Campbell et al. | |
| 8,956,112 | B2 * | 2/2015 | Tanahashi | F01D 5/282 415/200 |
| 9,726,028 | B2 * | 8/2017 | Marra | F01D 9/042 |
| 9,803,486 | B2 | 10/2017 | Freeman et al. | |

(Continued)

FOREIGN PATENT DOCUMENTS

| | | |
|---|---|---|
| EP | 1 176 284 A2 | 1/2002 |
| EP | 3 034 799 A1 | 6/2016 |

*Primary Examiner* — Logan Kraft
*Assistant Examiner* — Eric Zamora Alvarez
(74) *Attorney, Agent, or Firm* — Armstrong Teasdale LLP

(57) ABSTRACT

A blading member for fluid flow machines, for example, gas turbine engines. The blading member includes a platform member, at least one airfoil member, and at least one interlock member.

20 Claims, 4 Drawing Sheets

(56) References Cited

U.S. PATENT DOCUMENTS

| | | | |
|---|---|---|---|
| 2005/0254942 | A1 | 11/2005 | Morrison et al. |
| 2009/0196761 | A1 | 8/2009 | James |
| 2011/0041313 | A1 | 2/2011 | James et al. |
| 2011/0243724 | A1 | 10/2011 | Campbell et al. |
| 2011/0297344 | A1 | 12/2011 | Campbell et al. |
| 2012/0009071 | A1 | 1/2012 | Tanahashi et al. |
| 2013/0004294 | A1 | 1/2013 | Marra et al. |
| 2014/0334914 | A1 | 11/2014 | Brandl et al. |
| 2016/0177760 | A1 | 6/2016 | Brandl et al. |

* cited by examiner

BLADING MEMBER FOR A FLUID FLOW MACHINE

CROSS-REFERENCE TO RELATED APPLICATIONS

This application claims priority to European Application No. 14199453.3 filed Dec. 19, 2014, the contents of which are hereby incorporated in its entirety.

TECHNICAL FIELD

The present disclosure relates to the field of blading members for fluid flow machines. It further relates to an airfoil member and a platform member of blading members as mentioned above. Such blading members may for instance be applied in gas turbine engines.

BACKGROUND

It is known in the art to manufacture airfoils and platforms of blading members of fluid flow machines separately and to assemble a blading member from airfoil members and platform members. This offers various benefits, e.g. different materials may be used for the airfoil and the platform, complexity of the individual pieces is reduced, thus allowing for more complex cooling schemes, and in providing individual geometries more suitable for casting or machining. However, airfoils and platforms need to be joined properly and reliably.

EP 1 176 284 proposes joining airfoils and platforms by brazing. This results in the individual pieces being rigidly joined to each other and may lead to high thermal mismatch stresses. Moreover, separation of the pieces for reconditioning is difficult.

U.S. Pat. No. 5,797,725 discloses blading members wherein each of the airfoil and the platform comprise a corresponding flute which are filled by a common retainer. In a preferred embodiment the retainer is manufactured inside the flutes by casting. Joining the components according to this document requires extensive manufacturing steps. Also, due to the proposed casting step, limitations are implied with respect to the choice of materials for the retainer, the platform member and the airfoil member.

U.S. Pat. Nos. 7,686,571 and 7,704,044 propose coupling airfoils and platforms applying a mechanical interlock element, wherein said mechanical interlock element is slidably received inside flutes provided in the platform and along the pressure or suction side of the airfoil. The applicability of the connection is quite limited as not every mechanical interlock shape can be slidably pushed into the flutes. Furthermore, as curved retainer elements, resembling the curved shapes of the airfoil pressure and suction side, are completely received within the platform and are only accessible from front sides, it might be extremely difficult to remove the interlock members for servicing, inspection and reconditioning purposes, in particular if during operation an interlock element has seized up in a locking flute.

SUMMARY

It is an object of the present disclosure to provide a blading member for a fluid flow machine which comprises and is assembled from essentially at least one airfoil member and a platform member. It is a further object of the present disclosure to address the issues related to the assembly of a platform member of the kind initially mentioned. It is a further object of the present disclosure to provide an airfoil member which overcomes drawbacks of the art cited above. It is still a further object of the present disclosure to provide a platform member which overcomes drawbacks of the art cited above.

This is achieved in providing a blading member according to claim 1. It is further achieved in providing an airfoil member or a platform member according to any of the further independent claims.

In the context of this disclosure a blading member may be a part of a running blade row as well as a part of a stationary guide vane row, and a blading member may comprise one or more airfoils.

A blading member according to the present disclosure comprises a platform member and at least one airfoil member. The platform member comprises a platform receiver section, said receiver section comprising a first face and a second face. A receiver through opening is disposed in the receiver section and extends from the first to the second face.

The airfoil member extends from an airfoil base to an airfoil tip and comprises an airfoil member foot section and an airfoil member aerodynamic section, wherein the airfoil member foot section extends from the airfoil base to the airfoil member aerodynamic section and the airfoil member aerodynamic section extends from the airfoil member foot section to the airfoil tip. The airfoil member aerodynamic section projects from the platform member receiver section first face. The airfoil member foot section comprises an airfoil member male mating section received within the receiver through opening. At least one interlock receiver recess is provided on at least one of a platform member receiver section through opening inner wall and the airfoil member foot section. At least one interlock member is provided, said interlock member being partially received within an interlock receiver recess and comprising a section protruding from the interlock receiver recess, wherein the protruding section of the interlock member comprises at least one seating surface. An interlock counterpart seating surface is provided on the other one of the receiver section and the airfoil foot section. The seating surface provided on the protruding section of the interlock member and the counterpart seating surface are arranged and configured to bear on each other.

The blading member may comprise a multitude of airfoil members. All airfoil members comprised in one blading member may be connected to a platform in a similar manner and in particular in applying the teaching of the present disclosure.

Further, a second platform member or a shroud member may be arranged at and connected to the airfoil tip. The connection between the second platform member and the airfoil or the airfoils may be effected in the manner described in the present document or in any other suitable manner.

In further embodiments according to the present disclosure a retainer member is disposed and arranged to mate with an external surface of the interlock member and for securing the interlock member in the interlock receiver recess. In particular at least one interlock member is disposed on one of the airfoil member foot section and an inner wall of the platform member receiver through opening. The retainer member may be made from a low cost material as loading is small. The interlock member in turn may be made from a high-strength material. The retainer member may take additional functions, for instance may guide cooling air, may retain cooling air in a cavity between the retainer and the platform, or the retainer may contain features to enhance the heat transfer, and so forth.

According to the present disclosure, the airfoil member and the platform member are not rigidly locked to each other, but are locked to each other by means of an interlock member. This allows for e.g. largely unrestricted differential thermal expansion. Also, the airfoil member and the platform member may be made from different materials and may be manufactured by different processes. The airfoil member may for instance be manufactured by a directional solidification process, while the platform member may be a conventionally cast and thereafter machined member. Due to the mechanical interlock mechanism no issues related to dissimilar material welding processes or other methods of substance-to-substance bonding of dissimilar materials arise. No major heat intake due to bonding the airfoil member and the platform member takes place and issues related to the heat intake are avoided.

The interlock member itself is, in a cross sectional view, free of form locking features with the interlock receiver recess. In other words, the interlock member, when inserted into the interlock receiver recess, has a cross-sectional extent reaching into the interlock receiver recess, wherein a cross section along said cross-sectional extent may in specific embodiments be constant or tapering from an open interlock receiver recess top towards an interlock receiver recess bottom. The interlock member is provided within the interlock receiver recess from a "top" of the interlock receiver recess and is not held in place by an undercut or any other form locking feature of the receiver recess itself. Thus, as opposed to the art provided in e.g. U.S. Pat. Nos. 7,686,571 or 7,704,044 the interlock member does not need to be pushed in place, or be removed, along a longitudinal extend of the interlock member, or of the receiver recess, respectively, but can easily be inserted from the top of the interlock receiver recess. The retention of the interlock member in the interlock receiver recess may be effected by a retainer member or other retaining means, or an interlock member may be provided as a self-retained clamp-like member embracing the airfoil foot member or the cross section of the platform receiver through opening, as will be lined out in more detail below. Assembly of the blading member as well as disassembly for servicing and reconditioning are thus largely facilitated. In particular, the manner in which the interlock member is inserted into the interlock receiver recess allows the interlock receiver recess to be disposed on highly complex shaped surfaces.

It is understood that in particular if a retainer member is provided, the interlock member may as such be inserted loosely within the interlock receiver recess. This will allow easy insertion and removal of the interlock member into and from the interlock receiver recess.

The airfoil member will generally comprise a suction side and a pressure side, defined by the arrangement of a suction side and a pressure side provided on the airfoil member aerodynamic section. Consequently, as there is a well-defined arrangement of the airfoil member within the blading member, suction side areas and pressure side areas of further structural members of the blading member, in particular the platform member, are also well-defined locations. The receiver through opening has a well-defined relation to the airfoil member, and thus a suction side area and the pressure side area of the receiver through opening are well-defined. According to certain exemplary embodiments, at least one interlock member is provided on a suction side area of at least one of the airfoil foot section and an inner wall of the receiver through opening, and at least one interlock member is provided on the pressure side area of at least one of the airfoil member foot section and an inner wall of the receiver through opening. That means, at least two interlock members are provided, at least one interlock member being arranged on a pressure side area and at least one interlock member being arranged on a suction side.

In another exemplary embodiment an interlock member is provided spanning one of the airfoil foot section and an inner wall of the receiver through opening from a pressure side area to a suction side area. In this case, the interlock member resembles a clamp which may virtually embrace the cross section of the airfoil member foot section. For inserting the interlock member into the interlock receiver recess a deformation of the clamp-type member may be required. In one embodiment, the interlock member may be provided as a spring-type element, which is adapted to lock in place within the interlock receiver recess due to elastic deformation. That is, to arrange the interlock member in an interlock receiver recess provided on an airfoil member foot section, the interlock member is firstly elastically spread in order to move it to the receiver recess, and is thereafter released to lock within the receiver recess. To arrange the interlock member in an interlock receiver recess provided on an inner wall of the receiver through opening, the interlock member is firstly elastically compressed, introduced into the receiver through opening and moved to the location of the interlock receiver recess, and thereafter released to lock into the interlock receiver recess. In an alternative embodiment, the clamp-type interlock member may be inserted and retained in the interlock receiver recess by plastic deformation, e.g. by crimping it over an airfoil foot section. In still a further embodiment two individual interlock members are provided and inserted into an interlock receiver recess, and are thereafter joined e.g. by a substance-to-substance bond of the two individual interlock members to form one self-retained interlock member within the interlock receiver recess.

The retainer member and the interlock member may be weld connected to each other or may be connected by any other suitable substance-to-substance bond. As this connection is provided outside the interlock receiver recess, it may be arranged at a well-accessible location and may easily be disjoint for servicing or reconditioning purposes. Further, the application of the substance-to-substance bonding which comprises melting the involved materials is limited to a small area, and thus the heat intake and metallurgical issues related to heat intake are largely reduced.

In a further exemplary embodiment the interlock member and retainer member may be connected to each other by a form locking feature. To this extent one of an interlock member external surface and a retainer member comprises a concave locking feature and the other one of a corresponding interlock member external surface and a corresponding retainer member comprises a convex locking feature, wherein the convex locking feature is received within the concave locking feature, and wherein in particular the concave locking feature is a recess and the convex locking feature is a nose. This may be particularly suitable if the retainer member is a spring type member.

In still a further exemplary embodiment at least one interlock member and a corresponding retainer member are a single monobloc member.

A retainer member may be a spring-type element. Said spring type element may be configured such as to apply a force to the interlock member directed to the bottom of the interlock receiver recess.

At least one retainer member, comprising a first end and a second end, may be arranged such that the first end is interlocked with the platform member and the second end mates with or comprises at least one interlock member. In further exemplary embodiments one end of the retainer member may be weld connected or otherwise bond to the platform. Embodiments in which one end of the retainer member is locked with a bond to the platform are particularly suitable if the interlock retainer recess is provided on the airfoil member foot section.

In still further exemplary embodiments the first and the second ends of the retainer member may mate with or comprise at least one interlock member. This embodiment is particularly suitable in cases where the interlock retainer recess or recesses are provided on an inner wall of the receiver through opening.

At least one support shoulder may be disposed on the airfoil foot section and a counterpart support shoulder may be disposed on a receiver through opening inner wall or another suitable location of the platform member, wherein the support shoulder and the counterpart support shoulder abut each other.

In one embodiment of the blading member according to the present disclosure, the airfoil member foot section comprises a foot protrusion section projecting from the platform member receiver section second face, said protrusion section extending from the airfoil base to the airfoil member male mating section. The airfoil base is thus located outside the platform member receiver through opening. At least one interlock receiver recess is provided on the foot protrusion section and an interlock member is provided in said interlock receiver recess. A corresponding interlock counterpart seating surface is provided on the platform member receiver section second face. Consequently, the interlock counterpart seating surface is pointing towards the airfoil base. In a more specific variant of this embodiment a support shoulder is provided on the airfoil member, the support shoulder comprising a bearing surface pointing towards the airfoil base. A counterpart support shoulder with a counterpart bearing surface is provided on the platform member, in particular on an inner wall of the platform member receiver through opening. A part of the platform defined between the interlock counterpart bearing surface and the counterpart support shoulder is retained between the airfoil support shoulder and the interlock member, thus securing the platform member and the airfoil member to each other.

A method for assembling the airfoil member and the platform member of this embodiment comprises inserting the airfoil member foot section into the platform member receiver through opening from the first face towards the second face. The method may furthermore comprise introducing the airfoil member foot section into the platform member receiver through opening and forwarding the airfoil member foot section towards the second face until a support shoulder and a corresponding counterpart support shoulder abut each other, and subsequently inserting and retaining the interlock member within an interlock receiver recess provided on the airfoil member foot section and outside the platform member receiver through opening, the interlock member abutting the platform member receiver section second face.

In certain further exemplary embodiments the airfoil member foot section extends only partially through the platform member receiver through opening. The airfoil base is thus located within the through opening. At least one interlock receiver recess is provided on an inner wall of the receiver through opening, and an interlock member is provided in said interlock receiver recess. A corresponding counterpart seating surface for the interlock member is provided on the airfoil member foot section and is provided in particular on the airfoil base. In a more specific variant of this embodiment a support shoulder is provided on the airfoil member, the support shoulder comprising a bearing surface pointing towards the airfoil tip. A counterpart support shoulder with a counterpart bearing surface pointing toward the airfoil base is then provided on the platform member, and more specifically on an inner wall of the platform member receiver through opening. A part of the airfoil foot section defined between the airfoil base and the airfoil support shoulder is retained between the counterpart support shoulder and the interlock member, thus securing the platform member and the airfoil member to each other.

A method for assembling the airfoil member and the platform member of this embodiment comprises inserting the airfoil member aerodynamic section into the platform member receiver through opening and guiding the airfoil member aerodynamic section through said through opening from the second face to the first face, and inserting the airfoil member foot section into the platform member receiver through opening from the second face towards the first face. The method may furthermore comprise forwarding the airfoil member foot section inside the platform member receiver through opening and towards the first face until a support shoulder and a corresponding counterpart support shoulder abut each other, and subsequently inserting and retaining the interlock member within an interlock receiver recess provided on a platform member receiver through opening inner wall, the interlock member abutting the airfoil base.

Further, an airfoil member for a blading member as described above is disclosed. The airfoil member comprises an airfoil member aerodynamic section and an airfoil member foot section. In a first embodiment an interlock receiver recess is provided on the airfoil member foot section, and the airfoil member comprises a support shoulder, said support shoulder comprising a bearing surface, the bearing surface pointing towards an airfoil base. In another exemplary embodiment an interlock counterpart seating surface is provided on an airfoil base, and the airfoil member comprises a support shoulder, a bearing surface of said support shoulder pointing towards an airfoil tip.

Further a platform member for a blading member as described above is disclosed. The platform member comprises a receiver section. The receiver section comprises a first face and a second face. A receiver through opening is disposed in the receiver section and extending from the first face to the second face. In a first embodiment an interlock counterpart seating surface is provided on the second face and a support shoulder is arranged within the receiver through opening, wherein a bearing surface of said support shoulder points toward the first face. In a second embodiment an interlock receiver recess is provided on a platform member receiver through opening inner wall, and a support shoulder is provided within the receiver through opening, a bearing surface of said support shoulder pointing towards the second face.

It is understood, that the various features and embodiments described above may be combined with each other.

BRIEF DESCRIPTION OF THE DRAWINGS

The present invention is now to be explained more closely by means of different exemplary embodiments and with reference to the attached drawings. In brief, the drawings depict FIG. 1 a general overview of an airfoil member and a platform member according to the present disclosure.

Figure 1:
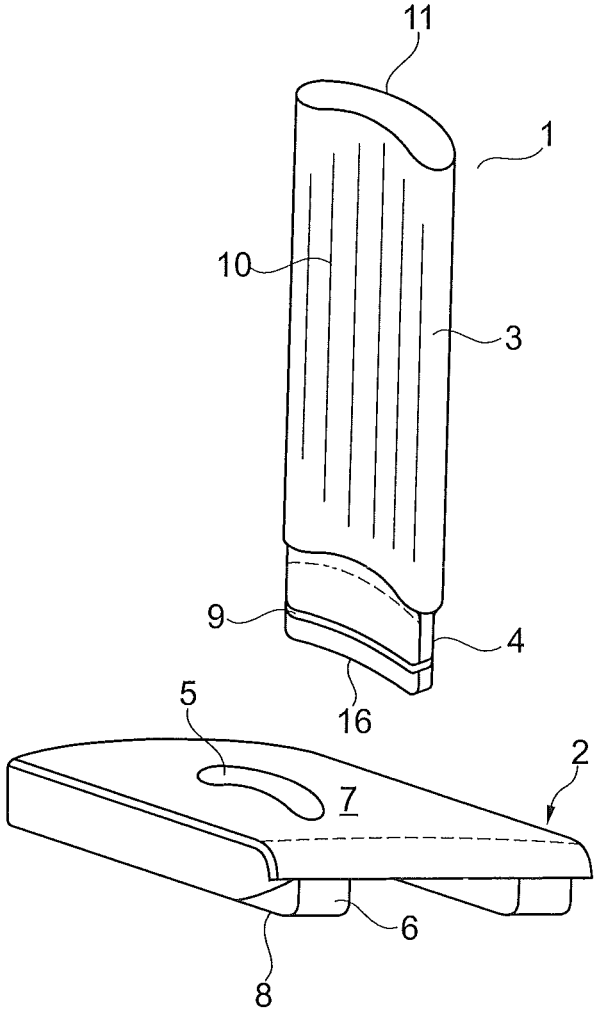

The drawings show schematic views, and features not required for the understanding of the present disclosure have been omitted. Further, the embodiments shown in the drawings have to be understood as exemplary embodiments only and are not intended to limit the scope of the present disclosure or the claimed invention.

DETAILED DESCRIPTION

FIG. 1 depicts a first exemplary embodiment of the blading member according to the present disclosure. Shown are an airfoil member 1 and a platform member 2. The airfoil member 1 comprises an airfoil member aerodynamic section 3 and an airfoil member foot section 4 extending from an airfoil base 16 to the airfoil aerodynamic section 3. The platform member 2 comprises a receiver through opening 5 provided in a receiver section 6 and extending from a first face 7 to a second face 8. The platform member receiver through opening 5 is shaped such as to receive airfoil member foot section 4. The airfoil foot section 4 further comprises an interlock receiver recess 9, which is shown as a groove running around the airfoil foot section 4. Furthermore, the airfoil member aerodynamic section 3 comprises a concavely curved pressure side 10 and a convexly curved suction side 11. The airfoil further comprises a leading edge and a trailing edge (without reference numerals) as is apparent to the skilled person. The leading edge and the trailing edge separate the pressure side and the suction side from each other. The interlock receiver recess 9, in this specific embodiment, runs as a flute around the foot section 4 from a suction side area to a pressure side area. However, other embodiments in which a multitude of interlock receiver recesses are arranged on the pressure and the suction side of the airfoil aerodynamic section, or, in other words, the interlock receiver recess is not one continuous flute, but an interrupted flute, thus resulting in said multitude of interlock receiver recesses. It may be found beneficial if the cross sections of the airfoil foot section and the airfoil aerodynamic section are by and large similar to each other. Thus, also the airfoil foot section may comprise a convexly shaped surface and a concavely shaped surface as well as the platform receiver through opening may receive a convexly shaped area and a concavely shaped area. The platform member may in other embodiments also comprise multiple receiver sections and receiver through openings and may thus be adapted to receive a multitude of airfoil members, such that a blading member may comprise a multitude of airfoils.

Figure 2:
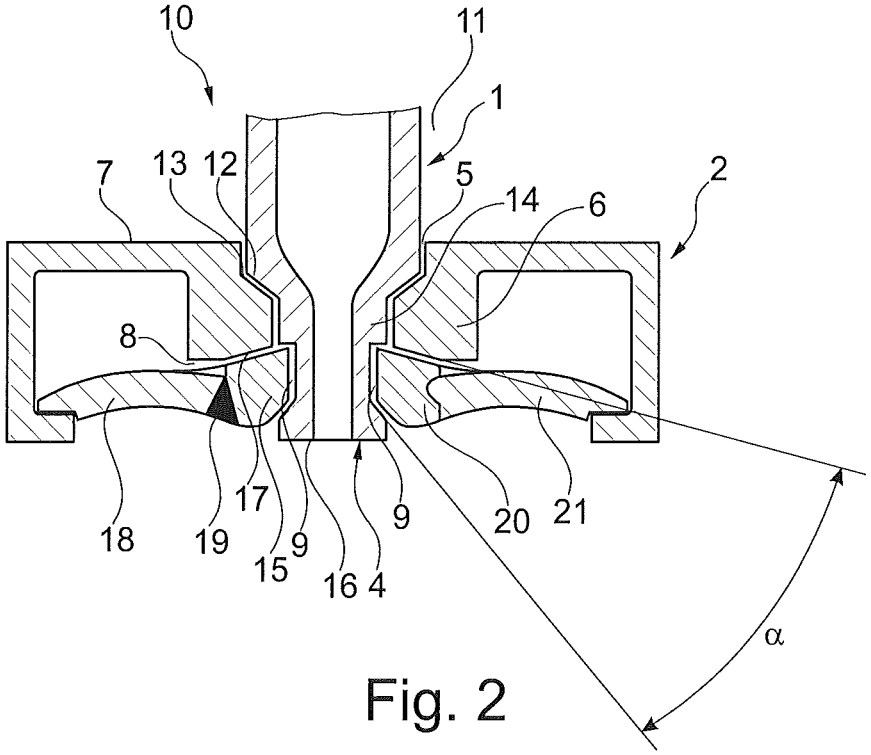
FIG. 2 details of a first configuration of the airfoil member and the platform member.

FIG. 2 depicts in more detail the assembly of the airfoil member and the platform member. The drawing depicts two possible embodiments of the interlock member. As is seen, the airfoil member 1 is inserted into the receiver opening 5 from top to bottom, or, more precisely said, from the first face 7 towards the second face 8 of the platform receiver section 6. The aerodynamic section of the airfoil member 1 is in this embodiment partially received within the platform receiver through opening 5 and projects from the first face 7. A support shoulder 12 is provided on the airfoil member and abuts a counter support shoulder 13 formed within the receiver through opening 5. A male mating section 14 of the airfoil member foot section 4 is received within the platform member receiver through opening 5 and may in particular fit snugly within the receiver through opening. The airfoil member foot section 4 in part projects from the platform member receiver section second face 8. An airfoil base 16 thus is located outside the receiver through opening. On the left-hand part of FIG. 2, a first exemplary configuration of an interlock member, a retainer member and an interlock receiver recess is shown. Interlock receiver recess 9 is provided in the airfoil foot section 4. An interlock member 15 is provided in the interlock receiver recess and comprises a section protruding therefrom. The protruding section of the interlock member 15 comprises a seating surface which will be lined out in more detail below. An interlock counterpart seating surface 17 is provided on the platform member receiver section second face 8 and bears the seating surface of the interlock member 15. A retainer member 18 is provided which is on the one hand interlocked with the platform and on the other hand mates with the interlock member 15. Retainer member 18 is weld-connected to interlock member 15 by a weld connection 19. To assemble the blading member, firstly the airfoil foot 4 is inserted through the receiver through opening 5 and forwarded from the first face 7 towards the second face 8 until support shoulder 12 abuts counterpart support shoulder 13. Then interlock member 15 is inserted into interlock receiver recess 9. Retainer member 18 is introduced into an undercut provided on platform member 2 and brought into abutting contact with interlock member 15. Thereafter, weld connection 19 is produced. The location of weld connection 19 is easily accessible if the blading member is not mounted to a rotor or a stator, and may thus be easily produced and also disjoined for inspection, servicing and reconditioning purposes. As is seen, a part of the platform receiver section is held between support shoulder 12 and the interlock member 15, and thus the platform member and the airfoil member are locked to each other. Brief reference is now made to FIG. 4*a*) which shows a cross section of interlock member 15. Interlock member 15 comprises an outer mating surface 151, seating surface 152 provided to bear on a counterpart seating surface 17, said seating surface in turn being provided on the receiver section second face 8, and a surface 153 provided to be at least partially received within the interlock receiver recess. Seating surface 152 and surface 153 are in this exemplary embodiment parallel to each other.

With reference to the right-hand side of FIG. 2 a second configuration of an interlock recess 9, an interlock member 20 and a spring type retainer member 21 is shown. With reference to FIG. 4*b*) interlock member 20 is shown in a cross section. It is seen that interlock member 20 comprises seating surface 202 provided to bear on the receiver section second face 8 and surface 203 provided to be at least partially received within the interlock receiver recess. Said two surfaces include an angle $\alpha$. A surface 201 is provided to mate with retainer member 21. Surface 201 is provided with an interlock recess 204, which is adapted and configured to receive a positive locking feature, for instance nose 214, provided on the retainer member 21. With reference back to FIG. 2 the effect of providing a wedge-shaped element with an angle $\alpha$ becomes more apparent. Spring-type retainer member 21 applies a force directed towards the ground of the interlock receiver recess 9 on the interlock member 20. Due to the wedge shape of interlock member 20 in the shown cross-section, a force directed from the platform member receiver section first face 7 towards the second face 8 becomes effective on the airfoil member 1, and the bearing surface of the support shoulder 12 is firmly pressed onto the corresponding counter support shoulder 13 provided in the platform receiver through opening.

Figure 3:
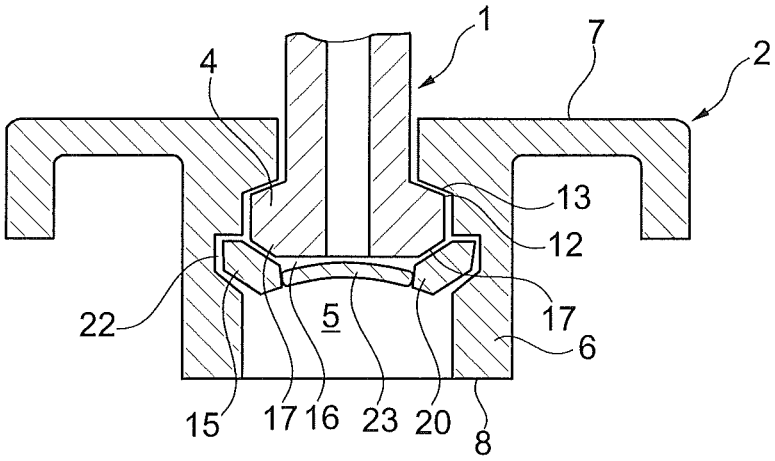
FIG. 3 details of a second configuration of the airfoil member and the platform member.

With reference to FIG. 3, a reverse configuration is shown. The airfoil member 1 is inserted into the platform receiver through opening 5 in a direction from the second face 8 towards the first face 7. The airfoil member foot section extends only through a part of the platform member receiver through opening 5. Airfoil base 16 is thus located inside the receiver through opening 5. Support shoulder 12 points towards the airfoil tip and abuts a counter support shoulder 13 provided within the platform through opening. Interlock receiver recess 22 is provided on a platform member receiver through opening 5 inner wall. Interlock members 15, 20 are provided in the interlock receiver recess or recesses provided on opposite sides of the platform member receiver through opening. For the sake of complete illustration only, different configurations of interlock receiver recesses and interlock members are shown exemplarily on the left and right hand sides of FIG. 3. This is not a mandatory feature.

As lined out in the context of the description of the right-hand side of FIG. 2 the wedge-shaped geometry of the interlock member 20 serves to apply a force on the airfoil member which results in a pressure applied to the abutting support shoulders or surfaces 12, 13. This supports sealing the joint between the abuting surfaces of the support shoulder 12 and the counterpart support shoulder 13 against gas leakages through these corresponding mating surfaces. The wedge angle may be in a range from 10° to 60°, in particular in a range from 30° to 45°. The smaller the wedge angle a is the more force will be applied to the abutting support surfaces 12, 13. The bigger the angle is, however, the more will relative movements e.g. to accommodate for differential thermal expansion be facilitated. If the wedge angle is chosen too small, a self-locking effect of the interlock member may take place. It is understood that the respective counterpart surfaces for the interlock member wedge surfaces 202, 203, which counterpart surfaces are provided on the interlock receiver recess and on one of the airfoil base and the platform member receiver section second face are adapted and configured to provide a concave wedge configuration for receiving the interlock member wedge surfaces.

It is further understood that if the interlock member wedge angle is at least essentially 0°, in other words, the surfaces 152 and 153 are parallel as depicted in FIG. 4*a*), the respective counterpart surfaces are preferably also chosen parallel and are adapted to receive the interlock member in a loose fit or even with some play such as to avoid a deadlock of the interlock member. It will be appreciated that the statements made above as to the geometry of the interlock members and the counter surfaces provided on the interlock receiver recess on the one hand and on one of the airfoil base and the platform receiver section second face on the other hand apply independently of a specific configuration of the platform member, but are a general teaching as to the configuration of the interlock member and the structures provided abutting an interlock member.

A single spring-type retainer member 23 is provided bridging the interlock members on both sides of the receiver through opening inner wall and locking the interlock members in the interlock receiver recesses. The retainer member mates with the interlock members by means of form locking features, but may as well be e.g. weld connected with the interlock members.

Figure 5:
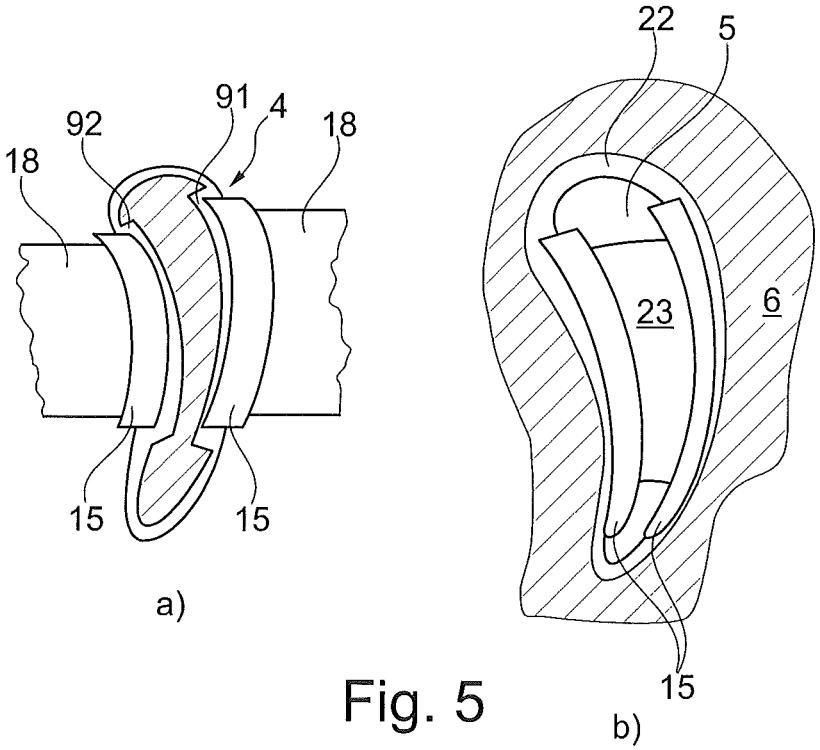
FIG. 5 exemplary embodiments of interlock members retained by retainer members.

The following drawings depict several embodiments of interlock members. FIG. 5 illustrates exemplary embodiments of interlock members held in place by retainer members. FIG. 5*a*) shows a cut through the foot section 4 of an airfoil member at the interlock receiver recess. More specifically, in this embodiment, a suction side interlock receiver recess 91 and a pressure side interlock receiver recess 92 are provided, each receiving an interlock member 15. It may be conceivable to arrange more than two interlock members, and also to provide more than two interlock receiver recesses. However, it might be found beneficial in order to facilitate assembling the blading member to restrict the number of interlock members to a minimum. The individual, independent, interlock members are held in place by retainer members 18.

FIG. 5*b*) illustrates an embodiment wherein two independent interlock members 15 are arranged in an interlock receiver recess 22 formed in a platform member receiver section 6. Interlock members 15 are held in place by a single retainer member 23, as depicted in FIG. 3.

Figure 4:
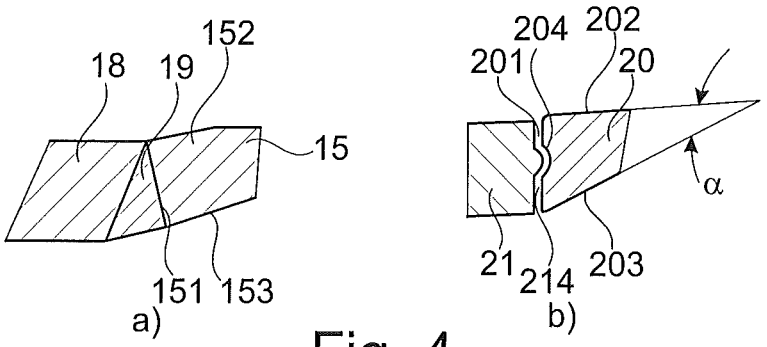
FIG. 4 cross-sectional views of different embodiments of an interlock member.
Figure 6:
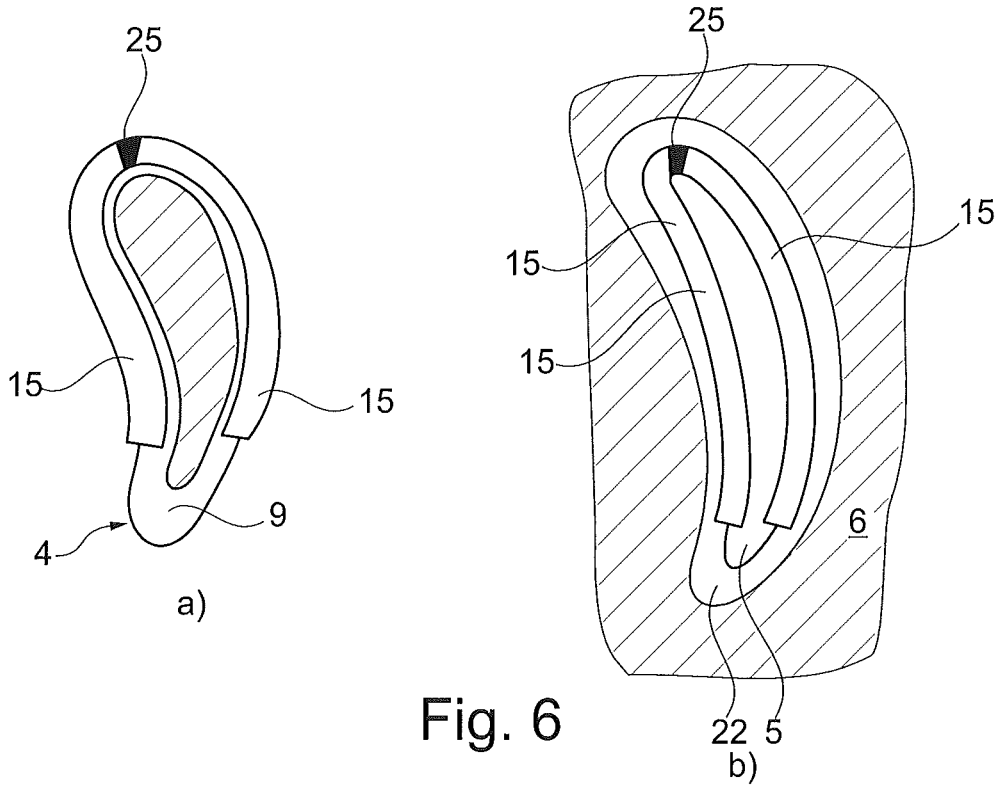
FIG. 6 exemplary embodiments of self-retaining interlock members.
Figure 7:
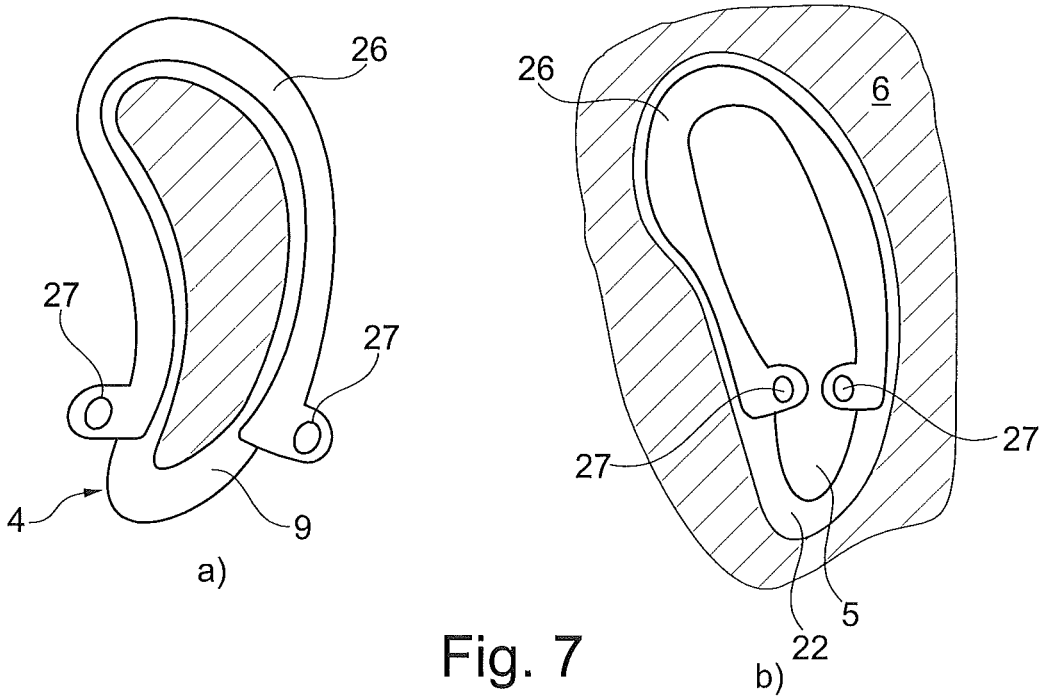
FIG. 7 exemplary embodiments of self-retaining spring-type interlock members.

FIGS. 6 and 7 illustrate embodiments of self-retaining interlock members. In the embodiment shown in FIG. 6*a*), two individual interlock members 15 are inserted into an interlock receiver recess 9 formed in the foot section 4 of an airfoil member. After having been inserted the individual interlock members 15 have been connected by a weld connection 25, and thus embrace the airfoil member foot section 4 to form a self-retaining interlock member. Likewise, in FIG. 6*b*) two individual interlock members 15 have been inserted into the interlock receiver recess 22 formed in a platform member receiver section 6. The individual interlock members 15 are weld connected at 25 and thus form a self-retaining structure within the interlock receiver recess 22. It will be appreciated that if choosing the self-retaining interlock member design and omitting the use of retainer members, it may be desirable that seating surface 152 and surface 153 of the interlock member, said surfaces depicted in FIG. 4, are parallel to each other in order to avoid the appearance of forces which would be capable of driving the interlock member out the interlock receiver recess.

FIG. 7 depicts embodiments of self-retaining spring-type interlock members. In FIG. 7*a*) a self-retaining spring-type interlock member 26 resembling the shape of a clamp is arranged in interlock receiver recess 9 provided in airfoil member foot section 4. Two eyes 27 are arranged on spring-type interlock member 26 and may be used to insert a tool suitable for spreading the spring-type interlock member 26 to insert it into interlock receiver recess 9. After releasing the spring-type interlock member 26, it will embrace the airfoil member foot section 4 at the interlock receiver recess 9 and thus provide a self-retaining interlock member. In a similar manner a spring-type interlock member 26 is placed in interlock receiver recess 22 formed in a platform member receiver section 6 in the exemplary embodiment shown in FIG. 7*b*).

Self-retaining interlock members may also be inserted into interlock receiver recesses by plastic deformation, for instance by crimping an interlock member onto an airfoil member foot section or pressing and interlock member into an interlock receiver recess formed in the platform member.

In the exemplary embodiments lined out above, the airfoil foot section and the platform receiver through opening have been shown with the cross section essentially resembling the cross section of an airfoil aerodynamic section. While this is a suitable embodiment, and may in particular be useful to avoid overly abrupt or stepwise changes of the airfoil member cross-section, this is not a mandatory feature.

While the invention has been lined out by virtue of exemplary embodiments above, other embodiments within the scope of the present disclosure and the claimed invention are apparent to the person skilled in the art.

The invention claimed is:

1. A blading member for a fluid flow machine, the blading member comprising:

a platform member including a platform member receiver section having a first face and a second face, and a platform member receiver through-opening disposed in the platform member receiver section, the platform member receiver through-opening extending from the first face to the second face;

at least one airfoil member extending from an airfoil base to an airfoil tip and including an airfoil member foot section and an airfoil member aerodynamic section, wherein the airfoil member foot section extends from the airfoil base to the airfoil member aerodynamic section and the airfoil member aerodynamic section extends from the airfoil member foot section to the airfoil tip, the airfoil member aerodynamic section projecting from the first face of the platform member receiver section, the airfoil member foot section including an airfoil member male mating section received within the platform member receiver through-opening, wherein at least one interlock receiver recess is provided on at least one of a platform member receiver section through-opening inner wall and the airfoil member foot section;

at least one interlock member partially received in the at least one interlock receiver recess and including a section protruding from the at least one interlock receiver recess, wherein the protruding section of the at least one interlock member includes at least one seating surface, wherein an interlock counterpart seating surface is provided on one of the platform member receiver section and the airfoil foot section, wherein the at least one seating surface provided on the protruding section of the at least one interlock member and the interlock counterpart seating surface are arranged and configured to bear on each other; and a retainer member disposed and arranged to mate with an external surface of the at least one interlock member and configured to secure the at least one interlock member in the at least one interlock receiver recess during operation of the fluid flow machine.

2. The blading member according to claim 1, wherein the airfoil member comprises a suction side and a pressure side, and wherein at least one of the at least one interlock member is provided on a suction side area of at least one of the airfoil foot section and an inner wall of the platform member receiver through-opening, and at least one of the at least one interlock member is provided on the pressure side area of at least one of the airfoil member foot section and an inner wall of the platform member receiver through-opening.

3. The blading member according to claim 1, wherein the airfoil member comprises a suction side and a pressure side, and wherein the at least one interlock member is provided spanning one of the airfoil foot section and an inner wall of the platform member receiver through-opening from a pressure side area to a suction side area.

4. The blading member according to claim 1, wherein the retainer member and the interlock member are connected by a substance-to-substance bond connection.

5. The blading member according to claim 1, wherein one of an interlock member external surface and a retainer member comprises a concave locking feature and another one of a corresponding interlock member external surface and a corresponding retainer member comprises a convex locking feature, wherein the convex locking feature is received within the concave locking feature.

6. The blading member according to claim 5, wherein the concave locking feature is a recess and the convex locking feature is a nose.

7. The blading member according to claim 1, wherein the at least one interlock member and the corresponding retainer member are a single monobloc member.

8. The blading member according to claim 1, wherein the retainer member is a spring-type element.

9. The blading member according to claim 1, comprising:

at least one retainer member including a first end and a second end, wherein the first end is interlocked with the platform member and the second end mates with or includes the at least one interlock member.

10. The blading member according to claim 1, comprising:

at least one retainer member including a first end and a second end, wherein the first and the second ends mate with or includes the at least one interlock member.

11. The blading member according to claim 1, wherein the airfoil member foot section comprises a foot protrusion section protruding from the platform member receiver section second face, said protrusion section extending from the airfoil base to the airfoil male mating section, the airfoil base thus being located outside the platform member receiver through-opening, wherein at least one interlock receiver recess is provided on the foot protrusion section, and the at least one interlock member is provided in said interlock receiver recess, and wherein a corresponding interlock counterpart seating surface is provided on the platform member receiver section second surface.

12. The blading member according to claim 1, wherein the airfoil member foot section extends only partially through the platform member receiver section, such that the airfoil base is located within the receiver through-opening, and wherein at least one interlock receiver recess is provided on an inner wall of the receiver through-opening, and the at least one interlock member is provided in said interlock receiver recess, and wherein a corresponding counterpart seating surface is provided on the airfoil foot section.

13. The blading member according to claim 1, comprising:

at least one support shoulder disposed on the airfoil foot section and a counterpart support shoulder is disposed on a platform member receiver through-opening inner wall, wherein the support shoulder and the counterpart support shoulder abut each other.

14. The blading member of claim 1, wherein the interlock receiver recess is provided on the airfoil member foot section and the airfoil member includes a support shoulder, a bearing surface of said support shoulder facing towards the airfoil tip.

15. The blading member of claim 1, wherein the interlock counterpart seating surface is provided on the second face and a counterpart support shoulder is arranged within the receiver through-opening, a bearing surface of said counterpart support shoulder facing toward the first face.

16. The blading member of claim 1, wherein the interlock counterpart seating surface is provided on the airfoil base and the airfoil member includes a support shoulder, a bearing surface of said support shoulder facing towards the airfoil base.

17. The blading member of claim 1, wherein the interlock receiver recess is provided on the platform member receiver through-opening inner wall and a counterpart support shoulder is provided within the receiver through-opening, a bearing surface of said support shoulder facing towards the second face.

18. A blading member for a fluid flow machine, the blading member comprising:

a platform member including a platform member receiver section having a first face and a second face, and a platform member receiver through-opening disposed in the platform member receiver section, the platform member receiver through-opening extending from the first face to the second face;

at least one airfoil member extending from an airfoil base to an airfoil tip and including an airfoil member foot section and an airfoil member aerodynamic section, wherein the airfoil member foot section extends from the airfoil base to the airfoil member aerodynamic section and the airfoil member aerodynamic section extends from the airfoil member foot section to the airfoil tip, the airfoil member aerodynamic section projecting from the first face of the platform member receiver section, the airfoil member foot section including an airfoil member male mating section received within the platform member receiver through-opening, wherein at least one interlock receiver recess is provided on at least one of a platform member receiver section through-opening inner wall and the airfoil member foot section;

at least one interlock member partially received in the at least one interlock receiver recess and including a section protruding from the interlock receiver recess, wherein the protruding section of the interlock member includes at least one seating surface, wherein an interlock counterpart seating surface is provided on one of the platform member receiver section and the airfoil foot section, wherein the at least one seating surface provided on the protruding section of the interlock member and the interlock counterpart seating surface are arranged and configured to bear on each other, and the airfoil member includes a suction side and a pressure side, and wherein the at least one interlock member is provided spanning one of the airfoil foot section and an inner wall of the platform member receiver through-opening from a pressure side area to a suction side area.

19. A blading member for a fluid flow machine, the blading member comprising:

a platform member including a platform member receiver section having a first face and a second face, and a platform member receiver through-opening disposed in the platform member receiver section, the platform member receiver through-opening extending from the first face to the second face;

at least one airfoil member extending from an airfoil base to an airfoil tip and including an airfoil member foot section and an airfoil member aerodynamic section, wherein the airfoil member foot section extends from the airfoil base to the airfoil member aerodynamic section and the airfoil member aerodynamic section extends from the airfoil member foot section to the airfoil tip, the airfoil member aerodynamic section projecting from the first face of the platform member receiver section, the airfoil member foot section including an airfoil member male mating section received within the platform member receiver through-opening, wherein at least one interlock receiver recess is provided on at least one of a platform member receiver section through-opening inner wall and the airfoil member foot section;

at least one interlock member partially received in the at least one interlock receiver recess and including a section protruding from the interlock receiver recess, wherein the protruding section of the interlock member includes at least one seating surface, wherein an interlock counterpart seating surface is provided on one of the platform member receiver section and the airfoil foot section, wherein the at least one seating surface provided on the protruding section of the interlock member and the interlock counterpart seating surface are arranged and configured to bear on each other, at least one retainer member including a first end and a second end, wherein the first and the second ends mate with or includes the at least one interlock member.

20. The blading member according to claim 18, comprising:

a retainer member disposed and arranged to mate with an external surface of the interlock member and securing the interlock member in the interlock receiver recess.

* * * * *